US008091186B2

(12) United States Patent
Takazawa et al.

(10) Patent No.: US 8,091,186 B2
(45) **Date of Patent: *Jan. 10, 2012**

(54) SLIDER FOR A FLUID TIGHT SLIDE FASTENER

(75) Inventors: Shigeyoshi Takazawa, Anaheim, CA (US); Morimasa Yoneoka, Chung Li (TW)

(73) Assignee: YKK Corporation, Tokyo (JP)

( * ) Notice: Subject to any disclaimer, the term of this patent is extended or adjusted under 35 U.S.C. 154(b) by 106 days.

This patent is subject to a terminal disclaimer.

(21) Appl. No.: 12/277,381

(22) Filed: Nov. 25, 2008

(65) Prior Publication Data

US 2009/0139068 A1 Jun. 4, 2009

(30) Foreign Application Priority Data

Nov. 30, 2007 (GB) ..... 0723493.3

(51) Int. Cl.
*A44B 19/26* (2006.01)

(52) U.S. Cl. ..... 24/415; 24/430; 24/389; 24/427; 24/428

(58) Field of Classification Search ..... 24/415, 24/389, 403, 392, 401, 391, 417, 428, 427, 24/431, 416, 585.1, 585.11, 585.12
See application file for complete search history.

(56) References Cited

U.S. PATENT DOCUMENTS

| | | | | |
|---|---|---|---|---|
| 3,111,738 | A | 11/1963 | Bair | |
| 3,818,549 | A * | 6/1974 | Moertel | 24/428 |
| 4,055,876 | A * | 11/1977 | Ackermann et al. | 24/421 |
| 4,409,705 | A * | 10/1983 | Yuunaga | 24/415 |
| 4,562,622 | A * | 1/1986 | Takabatake | 24/427 |
| 5,517,733 | A | 5/1996 | Chao | |
| 6,092,266 | A * | 7/2000 | Lee | 24/389 |
| 6,343,408 | B1 * | 2/2002 | Neugebauer | 24/389 |
| 6,490,770 | B1 * | 12/2002 | Matsuda et al. | 24/428 |
| 6,497,014 | B2 * | 12/2002 | Neugebauer | 24/389 |
| 6,530,132 | B2 * | 3/2003 | Yamagishi et al. | 24/427 |
| 6,622,351 | B2 * | 9/2003 | Takasawa | 24/415 |
| 7,059,024 | B2 * | 6/2006 | Yoneoka et al. | 24/391 |
| 7,257,868 | B2 * | 8/2007 | Yoneshima | 24/415 |
| 2002/0017010 | A1 * | 2/2002 | Neugebauer | 24/391 |
| 2007/0107171 | A1 | 5/2007 | Kojima | |

FOREIGN PATENT DOCUMENTS

| | | |
|---|---|---|
| EP | 1 057 423 A1 | 12/2000 |
| EP | 1 175 842 B1 | 4/2006 |
| EP | 1 900 297 A1 | 3/2008 |

OTHER PUBLICATIONS

European Search Report for EP Application No. 08 25 3819 dated Aug. 18, 2011.

* cited by examiner

*Primary Examiner* — Robert Sandy
*Assistant Examiner* — Rowland D Do
(74) *Attorney, Agent, or Firm* — Alston & Bird LLP

(57) ABSTRACT

A slider for a fluid tight slide fastener has upper and lower wings joined by a guide post and a guide plate provided between the upper and lower wings and spaced there from to cooperate with the upper and lower wings to guide coupling elements and sealing lips of the slide fastener. The upper wing is provided with upper side flanges which extend from the trailing end of the upper wing to a position at least as far forward as the forward end of the guide post.

16 Claims, 7 Drawing Sheets

SLIDER FOR A FLUID TIGHT SLIDE FASTENER

FIELD OF INVENTION

This invention relates to a slider for a fluid tight fastener of the type described in EP 1 057 423 A1 and EP 1 175 842 A1, the contents of which are incorporated herein by reference. A coil like continuous coupling member is sewn onto a tape surface near an edge of the tape. The other surface of the tape is coated with a fluid proof layer which extends beyond the edge of the tape to form a sealing lip. When the coupling members of adjacent tapes are engaged, the sealing lips of the fluid proof layers abut to form a seal. Such fasteners can provide a reasonably good seal against liquids or gasses, depending on various factors such as the design of the sealing lips of the fluid proof layers, the extent to which they are urged together by the coupled elements and the extent of flexing of the fastener in use.

BACKGROUND OF THE INVENTION

The slider shown in EP 1 057 423 A1 and EP 1 175 842 A1 incorporates a guide plate or "guide flange" in the form of a thin blade which projects from the wedge or guide post which joins the upper and lower wings of the slider. This guide plate extends between the outer ends of the coupling elements and the sealing lips. Thus the guide plate creates upper and lower paths within the slider and serves to ensure more accurate alignment of the coupling elements as they are brought together and enables greater pressure to be exerted on the sealing lips whilst keeping them aligned.

In practice, the slider shown in EP 1 057 423 A1 and EP 1 175 842 A1 has been made of three parts, with the guide plate being formed separately and sandwiched between the upper and lower wings and guide post portions on each wing. This adds significantly to the cost of the production process.

EP 1 900 297 A1 describes an integrally formed slider. In particular the slider may be die cast or moulded as a single, integral member of metal or plastics material. By integrally forming the slider, the slider is stronger, particularly in the region between the upper plate and the guide plate where the slider parts are subject to greater separation forces as the slider is pulled along the fastener to urge the sealing lips together. This substantially reduces the cost of the production process and also leads to an improvement in product quality because of the avoidance of any misalignment or other errors which may arise in an assembly process.

A difficulty with the prior art slider design was the use of a relatively thin guide plate which extended a relatively long distance from the guide post and so was unsupported. This could not be reliably moulded as an integral part of the slider.

Although the guide plate in EP 1 900 297 A1 is shaped to provide a thicker guide plate and also a smooth path for the sealing lips, there are still difficulties in ensuring that the slide fastener tapes always mate properly to form a good seal. For example the sealing lips may slip out from between the upper and lower wings of the slider or the coils may slide up alongside the edge of the guide plate.

BRIEF SUMMARY OF VARIOUS EMBODIMENTS OF THE INVENTION

Various embodiments of the present invention provide a slider for a fluid tight slide fastener. The slider has upper and lower wings joined by a guide post and a guide plate provided between the upper and lower wings. The guide plate is configured to cooperate with the upper and lower wings to guide the coupling elements and sealing lips of the slide fastener, wherein the upper wing is provided with upper side flanges which extend to a position at least as far forward as the forward end of the guide post. In certain embodiments, the upper side flanges extend at least as far forward as the forward end of the guide plate. In a particular embodiment, the upper side flanges extend to the forward edge of the upper wing.

In various embodiments, the inner surface of the upper side flanges, at the forward end of the flanges, are formed at an obtuse angle to the wing. In one embodiment, the angle is at least 120 degrees. In a further embodiment, the angle is about 135 degrees.

In addition, according to certain embodiments, the inner surface of the upper side flanges at the trailing end of the upper side flanges is substantially perpendicular to the plane of the upper wing. In a particular embodiment, the angle of the inner surface of the upper flange to the plane of the upper wing changes substantially uniformly from the obtuse angle to the perpendicular along the length of the flange.

According to various embodiments, the wings have a trailing portion having substantially parallel sides, a forward portion wider than the trailing portion and having substantially parallel sides, and a mid portion which tapers from the forward portion to the trailing portion.

In certain embodiments, the lower side flanges on the lower wing extend along the sides of the trailing portion and tapering portion of the lower wing and part way along the sides of the forward portion of the lower wing. In a particular embodiment, the lower side flanges extend forwards to a position level with a mid point of the guide post.

According to one embodiment, the inner surface of the lower side flange is substantially flat from the leading end of the side flange to the junction of the tapering portion with the trailing portion.

In various embodiments, the upper side flanges of the upper wing extend farther forward of the slider than the lower side flanges of the lower wing.

In a particular embodiment, the upper side flanges extend to a position at least as far forward as the forward end of the guide post, while the lower side flanges extend to a position at least as far rearward as the forward end of the guide post.

Other aspects and features of various embodiments of the invention will be apparent from the following description and the accompanying claims.

BRIEF DESCRIPTION OF THE DRAWINGS

Various embodiments of the invention will be further described by way of example with reference to the accompanying drawings in which.

DETAILED DESCRIPTION OF VARIOUS EMBODIMENTS OF THE INVENTION

Figure 1:
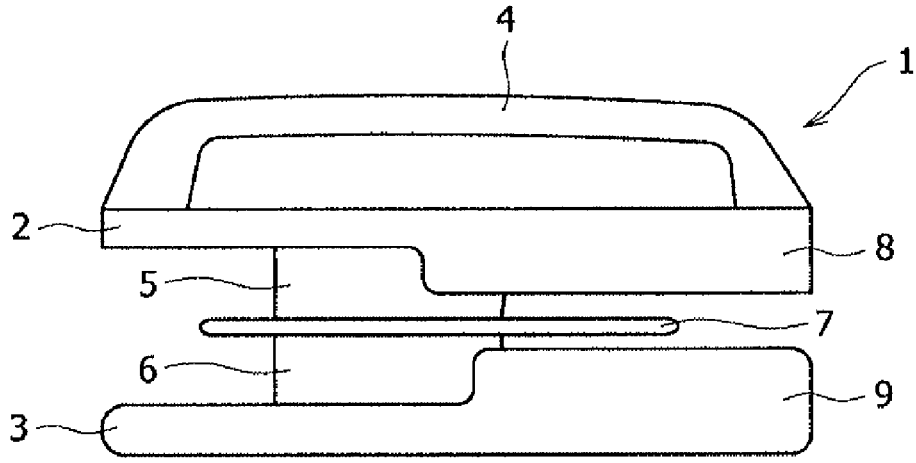
FIG. 1 (Prior Art)
FIG. 1 is a side view of a prior art slider.
Figure 2:
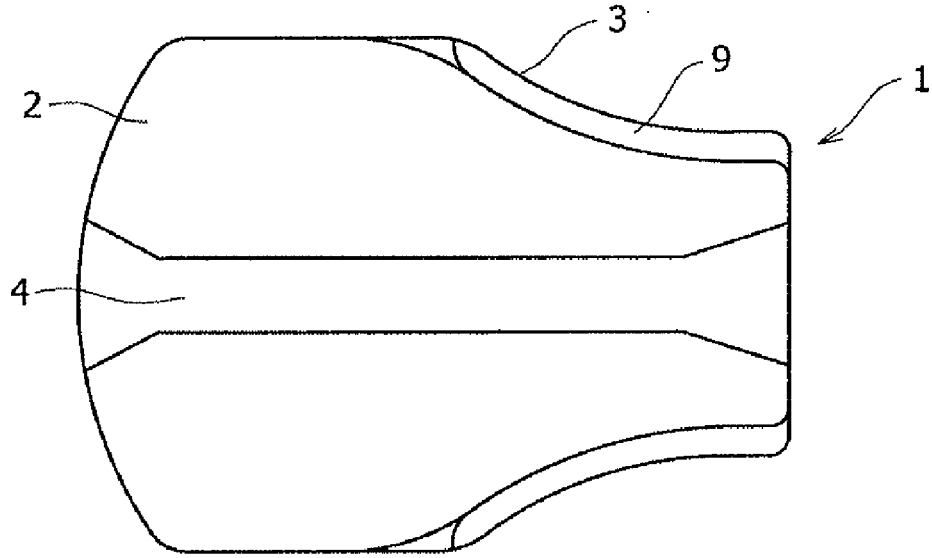
FIG. 2 (Prior Art)
FIG. 2 is a plan view of the slider of FIG. 1.
Figure 3:
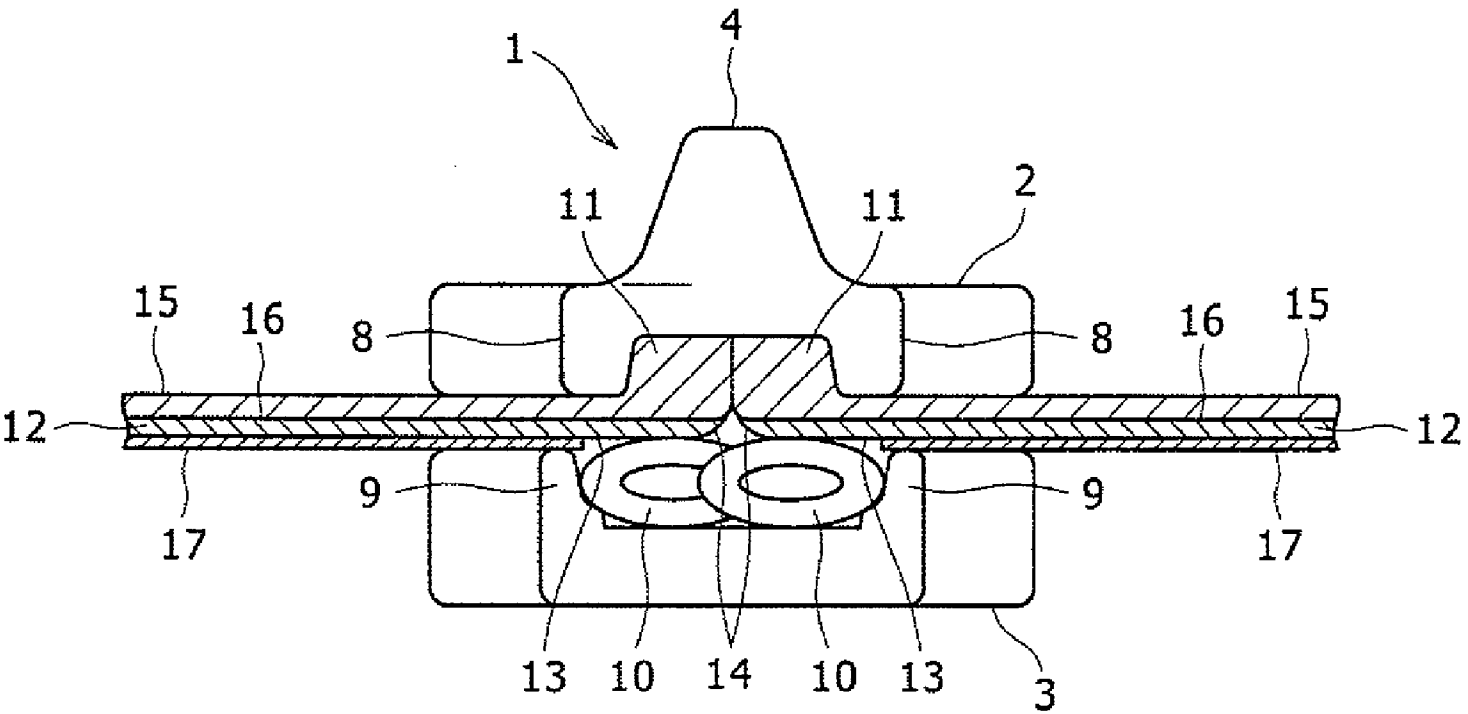
FIG. 3 (Prior Art)
FIG. 3 is an end view of the slider of FIGS. 1 and 2, on a slider fastener, from the trailing end of the slider.

Referring to FIGS. 1 and 2, these show a side view and plan view of a prior art slider 1. Slider 1 has a pair of upper and lower wings 2, 3 disposed in parallel spaced relation to each other and a bridge 4 formed on the upper surface of the upper wing 2 for receiving a slider puller (not shown). An upper guide post half 5 extends from the lower surface of the upper wing 2 towards the lower wing 3, and a lower guide post 6 extends from the opposed or upper surface of the lower wing 1 towards the upper wing 2, and the upper and lower guide post halves 5, 6 sandwich a guide plate 7 between them. A guide plate 7 is disposed between the upper wing 2 and the lower wing 3 in parallel spaced relation with the upper and lower wings 2, 3 with predetermined intervals. As being thus disposed, the guide plate 7 defines with the upper wing 2 a space to allow a pair of sealing lips 11 provided on the fluid tight slide fastener to pass therethrough and it also defines with the lower wing 3 a space to allow a pair of coupling elements 10 provided on the fluid tight slide fastener to pass therethrough. As seen in FIG. 3, side flanges 8 depend from the opposed sides of the upper wing 2 towards the lower wing 3 at the trailing end of the upper wing 2 and serve to urge the opposed sealing lips 11, 11 of the fastener together. Furthermore, side flanges 9 depend from the opposed sides of the lower wing 2 towards the upper wing 3 at the trailing end of the lower wing 3 and serve to urge the opposed coupling elements 10, 10 of the fastener together. As also illustrated in FIG. 3, the fluid tight slide fastener comprises a pair of opposed tapes 12 with coil like coupling elements 10 mounted on one or the lower surface 13 near the outer edge 14 of the respective tapes. A fluid proof coating 15, such as a rubber, elastomer or thermoplastics material, is provided on the other or the upper surface 16 of each tape 12 so as to cover the upper surface 16. The coating 15 extends beyond the outer edge 14 of the respective tape 12 to form sealing lips 11 which are guided by the guide plate 7 and upper wing 2 into an abutting, sealing position as the coupling elements 10 are coupled together. A reinforcing tape 17 is provided on the underneath surface of the tapes 12.

Figure 4:
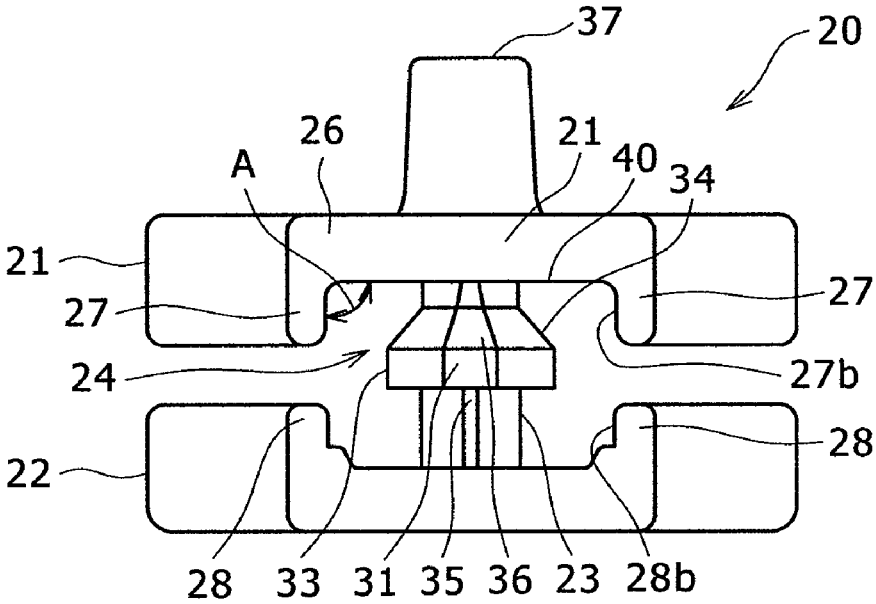
FIG. 4 is a view of the trailing end of a slider forming an embodiment of the invention.

Referring to FIGS. 4 to 9, these show a slider 20 in accordance with one embodiment of the invention, for a fluid tight slide fastener of the type described above. The slider has upper and lower wings 21, 22 disposed in parallel spaced relation to each other and joined by a guide post 23. A guide plate 24 is disposed between the upper and lower wings 21, 22 so as to extend out from the guide post 23 towards the forward and trailing ends 25, 26 of the slider 20 (to the left and right respectively in FIG. 6). The guide plate 24 extends laterally to each side of the guide post 23, as seen in FIG. 4. As being thus disposed, the guide plate 24 defines with the upper wing 21*a* space to allow a pair of sealing lips 11 provided on the fluid tight slide fastener to pass therethrough and it also defines with the lower wing 22 a space to allow a pair of coupling elements 10 provided on the fluid tight slide fastener to pass therethrough. Furthermore, the upper and lower wings 21, 22, guide post 23 and guide plate 24 are integrally formed, that is formed of a single unitary piece. They may be formed of metal by die-casting or of plastics by moulding, for example. In an alternative embodiment, they may also be formed of separate parts as in the prior art designs.

Figure 6:
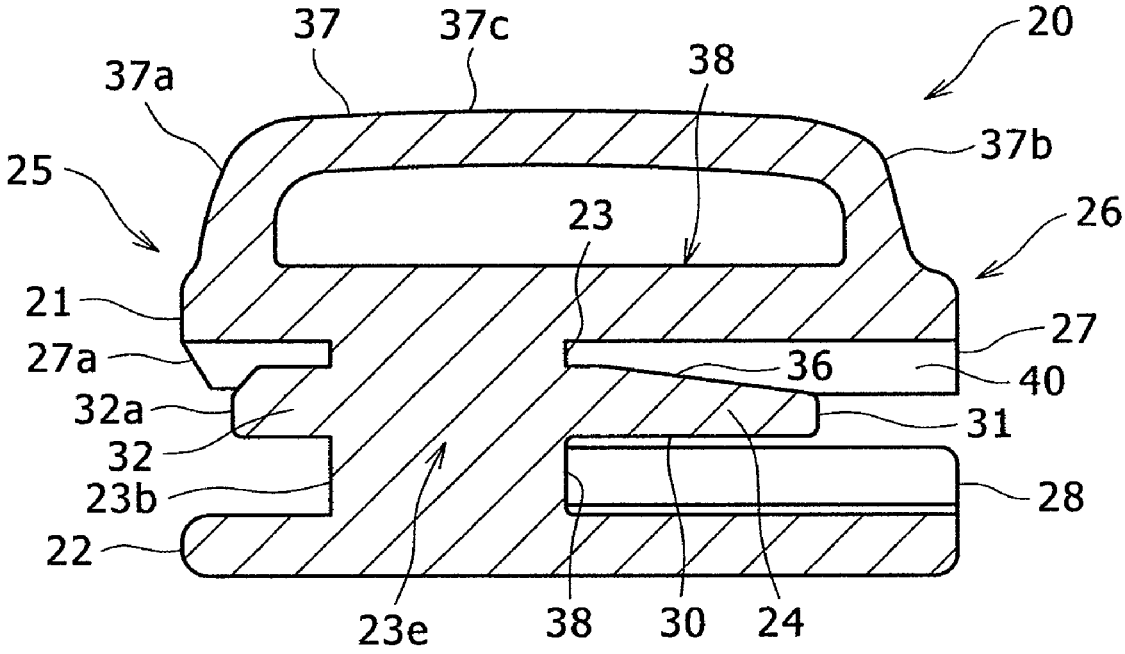
FIG. 6 is a longitudinal cross-section of the slider of FIG. 4.

A bridge 37 for attaching a puller (not shown) is also integrally formed on the upper surface 38 of the upper wing 21. As shown in FIG. 6., the bridge 37 includes a front leg 37a mounted on the front end 25 of the slider, a rear leg 37b mounted on the rear end 26 of the slider and a bridge proper 37c connecting the front and rear legs 37a, 37b. Other structures for attaching a puller may be used, as known in the art.

Figure 7:
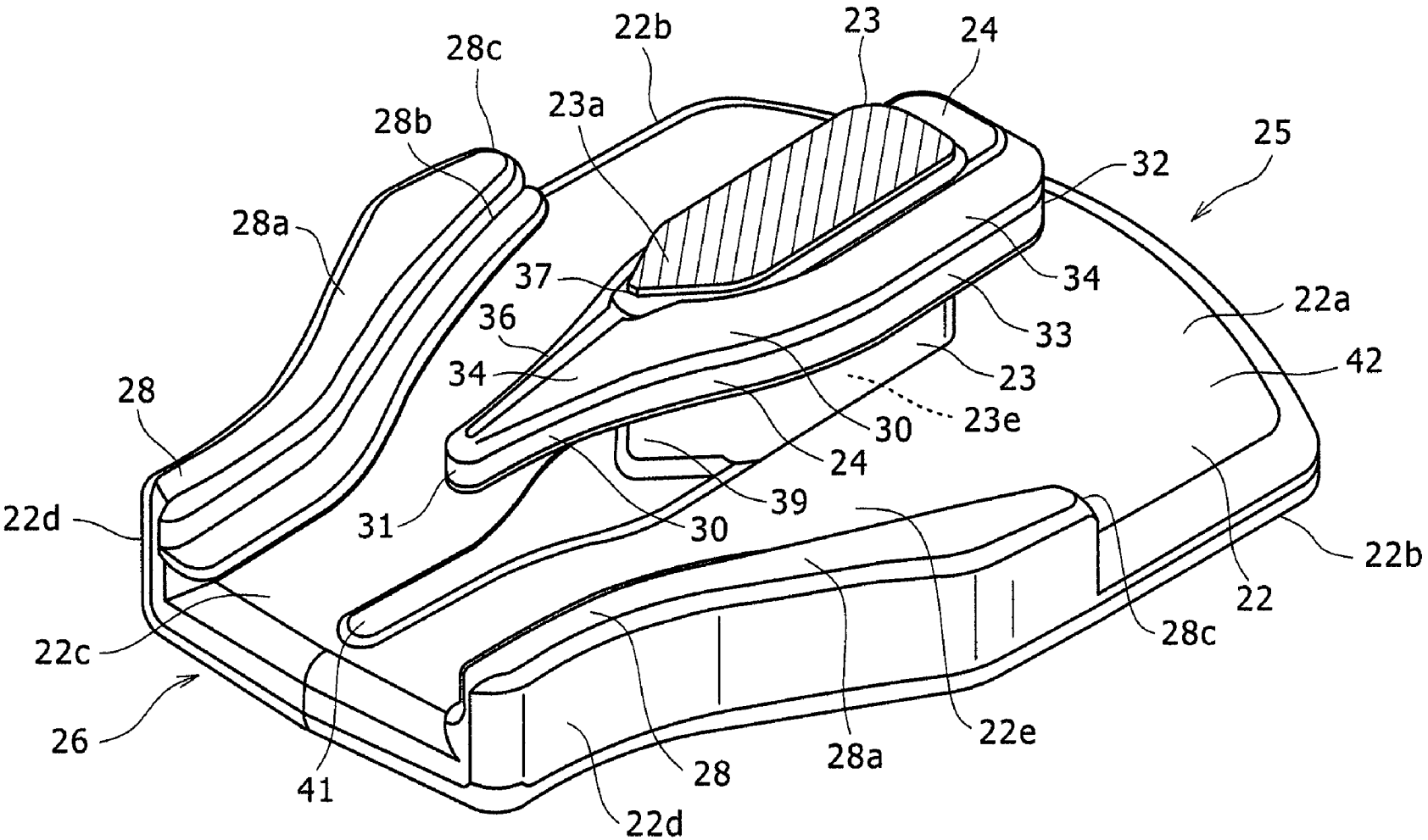
FIG. 7 is a perspective view of the slider of FIG. 4 with an upper wing cut away.
Figure 8:
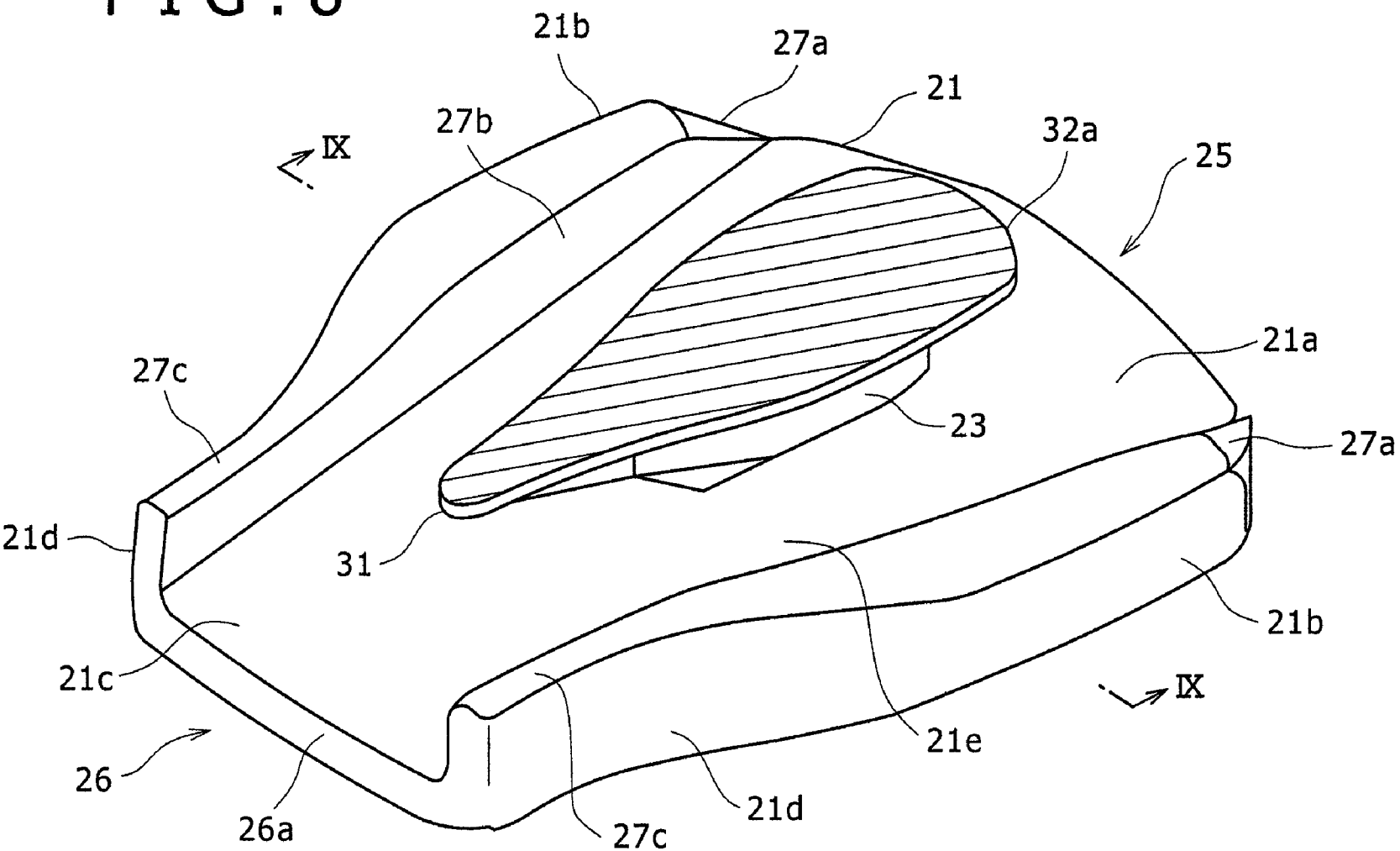
FIG. 8 is a perspective view of the slider of FIG. 4 inverted, with the lower wing cut away.
Figure 9:
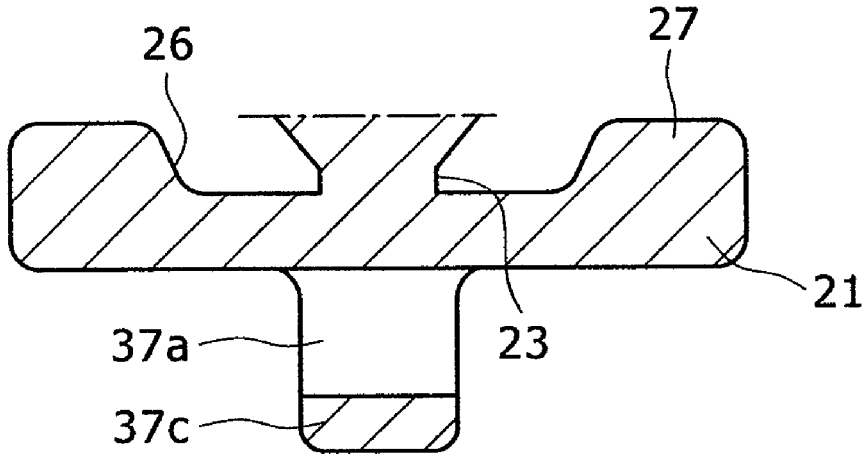
FIG. 9 is a cross section along the line IX-IX of FIG. 8.

The upper and lower wings 21, 22 are of generally the same outline or shape and, as seen in FIGS. 7 and 8, taper or gradually decrease in their lateral dimensions from the forward end 25 towards the trailing end 26. The upper and lower wings 21, 22 have a forward portion 21*a*, 22*a* having parallel opposed sides 21*b*, 22*b*, a rearward or trailing portion 21*c*, 22*c* also having parallel sides 21*d*, 22*d* and being narrower than the forward portion 21*a*, 22*a*, and a tapering portion 21*e*, 22*e* joining the forward and trailing portions 21*a*, 22*a*, 21*c*, 22*c*. The upper wing 21 has upper side flanges 27 extending from its opposed side edges toward the lower wing 22, and the lower wing 22 has lower side flanges 28 extending from its opposed side edges toward the upper wing 21. The flange portion 28a on the tapering portion 22*e* of the lower wing 22 serves to urge the pair of opposed coupling elements 10, 10 of the fluid tight slide fastener into coupling engagement, as known in the art, the elements being trapped between the wing 22 and the guide plate 24. The upper side flanges 27 serve to urge the pair of opposed sealing lips 11 of the fluid tight slide fastener together. Although the lips 11 would be pulled together as the coupling elements 10 are engaged, the side flanges 27 will reduce the strain on the coupling elements 10 and their connection to the tapes 12, and are also intended to serve to ensure consistent orientation of the sealing lips 11.

As noted above, forming the upper and lower wings 21, 22 guide post 23 and guide plate 24 as an integral unit serves to strengthen the slider 20. The strength is also enhanced by increasing the thickness of the guide plate 24. The mating area between the guide post 23 and the upper wing 21 may also be increased, but the guide post should not be too long as this may cause excessive deformation of the sealing lips 11 of the fluid tight slide fastener and possible stretching of them.

As better seen in FIG. 7, the guide post 23 has a generally rectangular cross-section with a rear end 23*a* tapering in its lateral dimension, ending in a trailing edge 39 of the guide post 23. In one embodiment, a round or elliptical cross-section for the guide post 23 may be provided, ending in a pointed or tapered rear end 23*a*.

A forward portion 32 of the guide plate 24 is thickened, being thicker than the trailing portion 30. The thickness of the forward portion 32 is continued rearward past the trailing edge 39 of the guide post 23 and the thickness of the trailing portion 30 gradually tapers towards the trailing end of the slider 20. The trailing portion 30 of the guide plate 24 has chamfers 34 formed on the respective outer edges 33 of the guide plate 24, thus forming a trailing surface 36 which tapers downward behind the trailing edge 39 of the guide post 23. This causes the trailing portion 30 have a rearward nose 31 constituting the trailing end 31 of the guide plate 24. The outer edge 33 of the forward portion 32 is tapered in thickness, the chamfer 34 facing the upper wing 21.

Also seen in FIG. 7 is a platform 41 on the upper surface 42 of the lower wing 22 which serves to help orient the opposed coupling elements 10 into adequate posture when they come into coupling engagement with each other, as known in the art. The platform 41 is disposed in confronting relation to the tailing portion 30 of the guide plate 24 and has a low height above the upper surface 42 of the lower wing 22.

The trailing portion 30 of the guide plate 24 tapers in width or lateral dimension towards the trailing end 26 of the slider 1, thus presenting a wedge-like shape as a whole. According to one embodiment, this ensures that the sealing lips 11 can pass smoothly through the slider 1 during the movement of the slider, thereby mitigating frictional resistance caused by the sealing lips' sliding movement against the guide plate 24.

In one embodiment, a space between the upper wing 21 and the hailing portion 30 of the guide plate 24 at the rear of the guide post 23 is provided to reduce the deformation of the sealing lips 11 of the fastener when they are held in the slider.

The shape and position of the upper and lower side flanges 27, 28 form a particular feature of various embodiments of this invention.

The upper side flanges 27 extend along the opposed sides of the upper wing 21 from the trailing end 26*a* of the upper wing 21 toward the forward end of the slider 20 to a position at least as far forward as the forward end 23*b* of the guide post 23. In this embodiment, as shown in FIG. 6, the upper side flanges 27 extend beyond the forward end 23*b* of the guide post 23 at the forward portion 21*a* of the upper wing 21 to a position at least as far forward as the forward end 32*a* of the guide plate 24. As seen in FIG. 6, the side flanges 27 extend just forwards of the guide plate 24, ending in a sloping face 27*a* at the forward end 25 of the upper wing 21.

Figure 5:
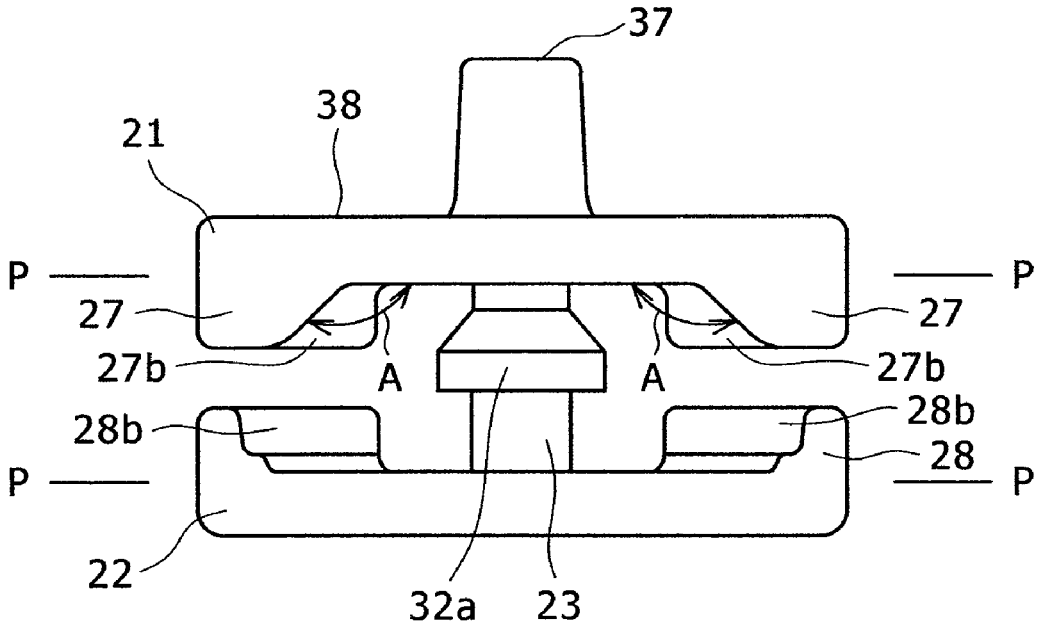
FIG. 5 is a view of the forward end of the slider of FIG. 4.

As seen in FIG. 5 in particular, inner surfaces 27*b* of the upper side flanges 27, at the forward end 25 of the slider 1, are formed at an obtuse angle A to the lower surface of the upper wing 21. The angle A is preferably between 120 degrees and 150 degrees. In this case, the inner surfaces 27*b* of the upper side flanges 27 subtend an angle of about 135 degrees with the lower plane P-P of the upper wing 21.

As seen in FIG. 4 and also in FIG. 5, the inner surface 27*b* of the upper side flanges at the trailing end 27*c* of the upper side flanges is substantially perpendicular to the lower plane of the wing 21. The angle of the inner surface 27*b* of the upper side flanges 27 to the plane of the upper wing 21 changes substantially uniformly from the obtuse angle to the perpendicular along the length of the flange 27, that is, from the forward end and trailing end of the slider 20, as indicate by the cross-section of FIG. 9. It can also be seen that the flange inner surface 27*b* extends in a substantially straight line from the forward end 25 of the slider to the trailing end of the tapered wing portion 21*e*.

The lower side flanges 28 on the lower wing 22 extend along the parallel sides 22*d* of the trailing portion 22*c* and the tapering portion 22*e* of the lower wing 22, and part way along the sides 22*b* of the forward portion 22*a* of the lower wing 22 to a position level with a mid point 23*e* of the length of the guide post 23 or fall short of the forward end 23*b* of the guide post 23. In other words, the lower side flanges 28 extend to a position at least as far rearward as the forward end of the guide post. See, for example, FIGS. 6 and 7. As a result, the upper side flanges 27 of the upper wing 21 extend farther forward of the slider 20 than the lower side flanges 28 of the lower wing 22.

The inner surface 28*b* of the lower side flange 28 is substantially planar from the leading end 28*c* of the side flange 28 to the junction of the tapering portion 22*e* of the lower wing 22 with the trailing portion 22*c* and perpendicular to the upper plane P-P of the lower wing 22.

Figure 10:
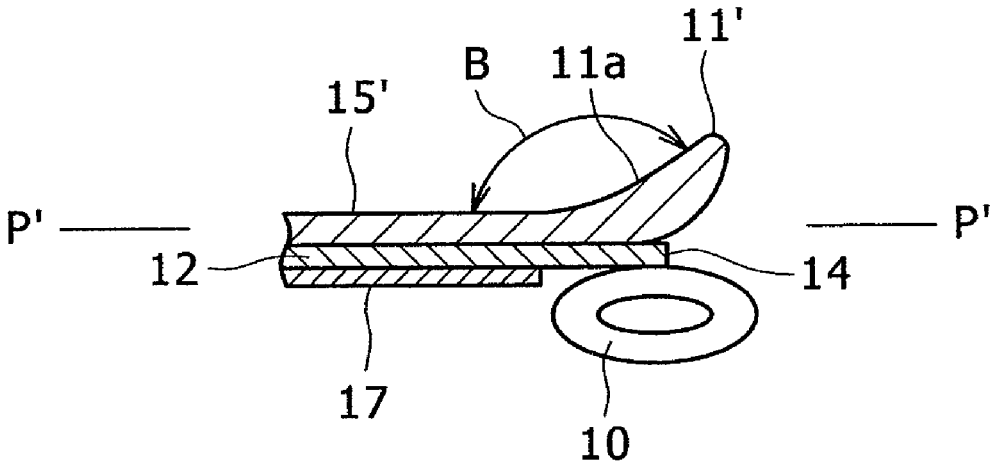
FIG. 10 is a cross section through an embodiment of a fastener stringer particularly suitable for use with the slider according to various embodiments of the present invention.

By extending the upper side flanges 27 towards the leading end 25 of the slider the sealing lips 11 can be oriented before the adjacent coupling elements are pressed together by the lower slide flanges. Referring to FIG. 10, this shows a stringer of a slide fastener with the sealing lip 11' extending beyond the outer edge 14 of the tape 12 and extending away from the plane of the tape 12. In one embodiment, the angle A at the leading end of the inner surface 27*b* of the upper side flange 27 corresponds to the angle B subtended by the upper surface 11*a* of the sealing lip 11' of the side fastener with the plane P'-P' of the fastener tape.

Although the description above contains many specificities, these should not be construed as limiting the scope of the invention but as merely providing illustrations of some of the present embodiments of this invention.

Thus the scope of the invention should be determined by the appended claims and their legal equivalents, rather than by the examples given.

The invention claimed is:

1. A slider for a fluid tight slide fastener, the slider having upper and lower wings joined by a guide post and a guide plate provided between the upper and lower wings and spaced there from, the guide plate configured to cooperate with the upper and lower wings to guide coupling elements and sealing lips of the slide fastener, the upper and lower wings have a forward end and a trailing end with the upper and lower wings being tapered towards the trailing end, and wherein the upper wing is provided with upper side flanges which extend from a trailing end of the upper wing in a direction from the trailing end of the upper wing to the forward end of the upper wing and to a position at least as far forward as a forward end of the guide post in said direction, wherein the forward end of the guide post faces the forward end of the upper and lower wings.

2. A slider as claimed in claim 1, wherein the upper side flanges extend at least as far forward as a forward end of the guide plate.

3. A slider as claimed in claim 2, wherein the upper side flanges extend to a forward edge of the upper wing.

4. A slider as claimed in claim 1, wherein an inner surface of each of the upper side flanges, at the forward end of each of the upper side flanges, is formed at an obtuse angle to the plane of the upper wing.

5. A slider as claimed in claim 4, wherein the angle is at least 120 degrees.

6. A slider as claimed in claim 5, wherein the angle is about 135 degrees.

7. A slider as claimed in claim 4, wherein the inner surface of each of the upper side flanges at a trailing end of each of the upper side flanges is substantially perpendicular to the upper wing.

8. A slider as claimed in claim 7, wherein an angle of the inner surface of the upper side flange to the plane of the upper wing changes substantially uniformly from the obtuse angle to the perpendicular along the length of the flange.

9. A slider as claimed in claim 1, wherein the wings have a trailing portion having parallel sides, a forward portion wider than the trailing portion and having substantially parallel sides, and a mid portion which tapers from the forward portion to the trailing portion.

10. A slider as claimed in claim 9, wherein the upper side flanges extend along the trailing portion, mid portion, and forward portion of the upper wing.

11. A slider as claimed in claim 9, the slide further comprising lower side flanges on the lower wing, wherein the lower side flanges extend along the sides of the trailing portion and tapering mid portion, and part way along the sides of the forward portion.

12. A slider as claimed in claim 11, wherein the lower side flanges extend forwards to a position level with a mid point of the guide post.

13. A slider as claimed in claim 11, wherein an inner surface of each lower side flange is substantially planar from a leading end of the lower side flange to the junction of the tapering mid portion with the trailing portion.

14. A slider as claimed in claim 1, wherein the upper side flanges of the upper wing extend farther forward of the slider than lower side flanges of the lower wing.

15. A slider as claimed in claim 14, wherein the upper side flanges extend to a position at least as far forward as the forward end of the guide post, and the lower side flanges extend to a position at least as far rearward as the forward end of the guide post.

16. A slider as claimed in claim 1, wherein the upper side flanges extend beyond the forward end of the guide post.

* * * * *

UNITED STATES PATENT AND TRADEMARK OFFICE

CERTIFICATE OF CORRECTION

PATENT NO. : 8,091,186 B2
APPLICATION NO. : 12/277381
DATED : January 10, 2012
INVENTOR(S) : Takazawa et al.

It is certified that error appears in the above-identified patent and that said Letters Patent is hereby corrected as shown below:

On the Title Page:

Item "(75) Inventors: Shigeyoshi Takazawa, Anaheim, CA (US); Morimasa Yoneoka, Chung Li (TW)" should read Item --(75) Inventors: Shigeyoshi Takazawa, Anaheim, CA (US); Morimasa Yoneoka, Chung Li City (TW)--

Signed and Sealed this
Sixth Day of March, 2012

David J. Kappos

David J. Kappos
*Director of the United States Patent and Trademark Office*